US008206073B2

(12) United States Patent
Fischer et al.

(10) Patent No.: US 8,206,073 B2
(45) Date of Patent: Jun. 26, 2012

(54) APPARATUS FOR PRESSING A BOOK CASING OR A SLIP-FOLD AGAINST AN ADHESIVE-COVERED BACK

(75) Inventors: Peter Fischer, Winterthur (CH); Theo Hug, Wallenwil (CH); Konrad Boos, Sirnach (CH)

(73) Assignee: Mueller Martini Holding AG, Hergiswil (CH)

( * ) Notice: Subject to any disclaimer, the term of this patent is extended or adjusted under 35 U.S.C. 154(b) by 884 days.

(21) Appl. No.: 12/181,762

(22) Filed: Jul. 29, 2008

(65) Prior Publication Data

US 2009/0035094 A1 Feb. 5, 2009

(30) Foreign Application Priority Data

Jul. 30, 2007 (EP) ..... 07405223

(51) Int. Cl.
*B42C 11/04* (2006.01)

(52) U.S. Cl. ..... 412/21

(58) Field of Classification Search ..... 412/21, 412/19, 20, 4, 5
See application file for complete search history.

(56) References Cited

U.S. PATENT DOCUMENTS 5,061,138 A * 10/1991 Allsopp et al. ..... 412/4
5,219,453 A * 6/1993 Furukawa et al. ..... 412/33
6,726,424 B2 * 4/2004 Voss ..... 412/3

FOREIGN PATENT DOCUMENTS

DE 102 27 950 A1 1/2004
EP 0 109 041 A1 5/1984
GB 2 149 351 A 6/1985
GB 2 300 382 A 11/1996

OTHER PUBLICATIONS

European Search Report dated Jan. 1, 2008 issued in EP 07 40 5223.

* cited by examiner

*Primary Examiner* — Edward Tolan
*Assistant Examiner* — Matthew G Katcoff
(74) *Attorney, Agent, or Firm* — Venable LLP; Robert Kinberg; Leigh D. Thelen

(57) ABSTRACT

An apparatus is provided for pressing a casing or a slip-fold against an adhesive-covered back and adjacent side flanks of a book block, which is conveyed while clamped into a circulating clamp of a perfect binder with the book back projecting downward. The apparatus includes a back pressing device for pressing the casing against the adhesive-covered back and a flank pressing device for pressing the casing against the side flanks. These devices are driven synchronized with the timing of the book binder clamps for conveying the book blocks. At least the flank pressing device is assigned an individual drive unit which is connected to a control device of the perfect binder.

7 Claims, 2 Drawing Sheets

APPARATUS FOR PRESSING A BOOK CASING OR A SLIP-FOLD AGAINST AN ADHESIVE-COVERED BACK

CROSS-REFERENCE TO RELATED APPLICATION

This application claims the priority of European Patent Application No. 07405223.4-1251, filed on Jul. 30, 2007, which is incorporated herein by reference in its entirety.

BACKGROUND OF THE INVENTION

The invention relates to an apparatus for pressing a book casing or a slip-fold against an adhesive-covered back and the adjacent side flanks of a book block, which is transported while clamped into a circulating clamp of a perfect binder with the back projecting downward. Such an apparatus includes a device for respectively pressing the casing against the adhesive-covered back, and a device for pressing the casing against the side flanks, wherein these devices are driven with the synchronous timing of the clamps for transporting the book blocks.

In a perfect binder, a casing or slip-fold is attached with the aid of adhesive to the back of a book block, composed of loosely gathered sheets. In the process, the back of the book block is first treated to ensure a good connection with the adhesive, the adhesive is then applied to the treated back and/or the casing or a slip-fold and the two parts are joined and pressed against each other. Perfect binders are provided with a plurality of clamps that are attached uniformly spaced apart to a traction device and circulate along an endless path. The book blocks are clamped into these clamps during the complete binding process, such that the backs of the book blocks project downward from the clamps and the side areas adjacent to the back, called the flanks, are freely accessible. Once the unbound book blocks have been transferred to these clamps, they are conveyed past the processing stations arranged along the circular path and are treated at these stations while they are conveyed past.

The shape and the strength of the book back are important quality features for the binding of a book and are determined in particular also by the function of pressing on the casing or the slip-fold. Known apparatuses for pressing a casing or slip-fold against the back of a book block include a flat back pressing device for pressing the casing against the book back, as well as a flank pressing device, for pressing the casing in the side area adjacent to the book back against the book block by using pressure bars. The shape of the back can be influenced by the chronological sequences between pressing the casing against the back and against the flanks. For example, the backs of books generally have a tendency to be rounded if the flank pressing device reaches the end position on the inside before the back pressing device reaches the upper final position. On the other hand, if the back pressing device reaches its upper end position before the flank pressing device reaches its inner end position, the book backs have a tendency to be angular. The stroke of the flank pressing device must therefore be adjusted to the product against which it is pressed. A larger stroke is generally required for processing the casings than for processing the slip-folds, which can be adjusted by replacing control cams or through a manual adjustment of the drive coupling system.

German patent document DE 102 27 950 A1 discloses an apparatus for pressing on a casing, which is provided with a control cam, a pivoting lever, and a cam roller for jointly controlling the operation of the flank pressure bars. By moving the lever to different positions, the stroke of the flank pressure bars can be adjusted. This solution has the disadvantage that the adjustments can mutually influence each other and that furthermore the phase position of the flank-pressing device, relative to the back pressing device, cannot be changed.

It is also known to operate the flank pressure bars directly with the aid of assigned control cams or crank gears, wherein at least the inside end position of a flank pressure bar is embodied to be adjustable for being adapting to the book thickness. The respective control cams or cranks must be replaced for changing the stroke of the flank pressure bar. A high time expenditure is required for replacing parts, which is a disadvantage of this solution.

During the pressing operation, there should be no or only an insignificant relative speed between the pressing operation and the book block in the longitudinal direction of the book back.

On the whole, the apparatus is operated either with the aid of a mechanical connection to the drive for the perfect binder, or with the aid of an individual electric drive, which follows the drive for the perfect binder.

Known solutions using only a single drive for the complete apparatus for pressing on a book casing or slip-fold have the disadvantage that the excess load safety for the single drive lacks response sensitivity because the drive must be adjusted such that it can securely transmit the maximum operating forces without responding. As a result, a response to an excess load of elements with a smaller force requirement is not possible. Known apparatuses furthermore have the disadvantage that mechanical drive elements such as cranks or control cams depend on the division between the clamps.

SUMMARY OF THE INVENTION

It is an object of the present invention to provide an apparatus for pressing on a casing or slip-fold, which can be adjusted and/or adapted with low expenditure during the operation to the requirements of the products to be produced.

The above and other objects are achieved according to one embodiment of the invention wherein in an apparatus for pressing a book casing or a slip-fold against an adhesive-covered back and the adjacent side flanks of a book block, as first described above, an individual drive unit is assigned to at least the flank pressing device, and such drive unit is connected to a control unit for the perfect binder.

BRIEF DESCRIPTION OF THE DRAWINGS

These and other features and advantages of the invention will be further understood from the following detailed description with reference to the accompanying drawings.

DETAILED DESCRIPTION

Figure 1:
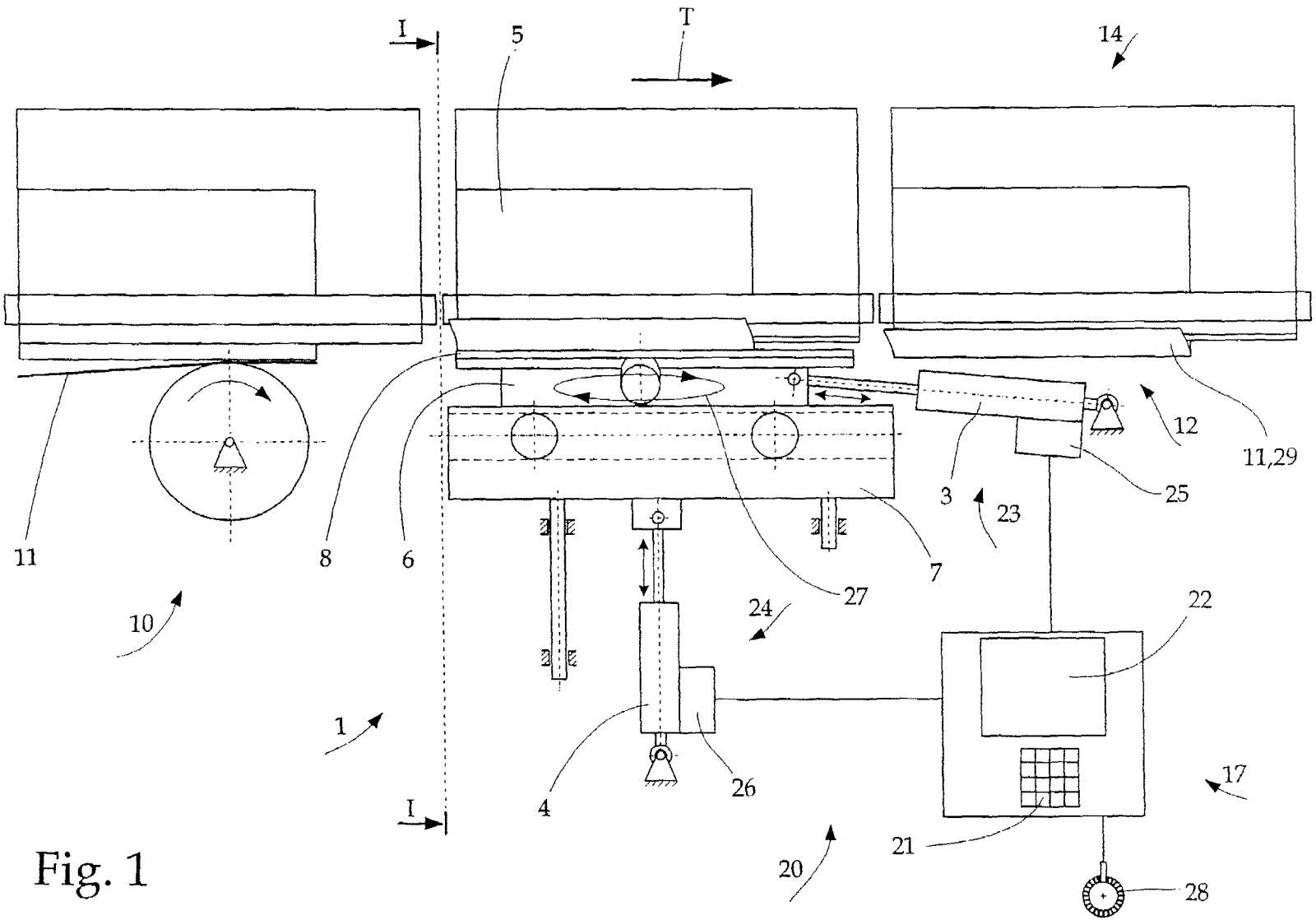
FIG. 1 shows a detail of a side view of a perfect binder with an apparatus for pressing on a casing or slip-fold.
Figure 2:
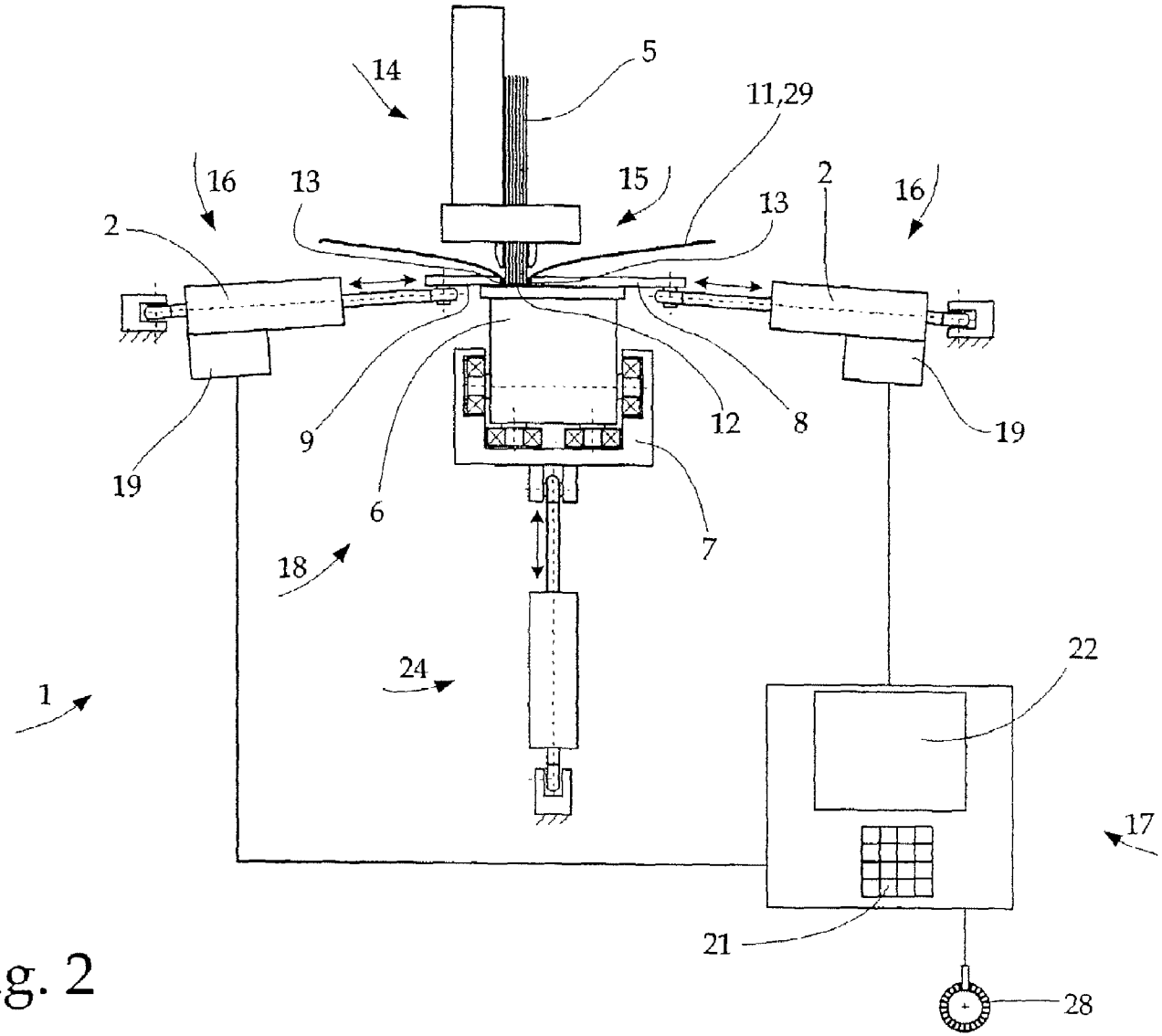
FIG. 2 is a view of a section along the plane I-I in FIG. 1.

The apparatus 1 shown in FIGS. 1 and 2 is attached exclusively to a machine frame of a perfect binder. The backs 12 and the adjacent side flanks 13 of the book blocks 5, against which the casings or slip-folds are pressed, are clamped into clamps 14 of the perfect binder with the backs 12 projecting downward, wherein the clamps circulate in a transporting direction T. In processing stations located upstream of the perfect binder (not shown herein), the backs 12 of the book blocks 5 are first treated to provide an optimum surface for applying the adhesive. With the aid of a joining device 10, arranged directly in front of the apparatus 1, the casings 11 that are supplied by a casing feeder are joined to the book blocks 5 in the region of the back 12 and are pressed against the latter. In FIG. 1, this joining device 10 is represented as a roller driven with the speed of the clamps 14. However, it is also conceivable to use for the joining operation a bar that is driven with the speed of the clamps 14 and lifts the casings 11 up to the backs 12 of the books blocks 5. In place of the casings 11, slip-folds 29 can alternatively also be attached at a slip-fold station to the adhesive-covered backs 12. The adhesive needed for joining the casings 11 or the slip-folds 29 to the book blocks 5 is applied with the aid of roller application systems or nozzle application systems, prior to joining the book blocks 5 and the casings 11 and/or slip-folds 29. The apparatus 1 essentially consists of a flank pressing device 15, provided with a front pressure bar 8 and a rear pressure bar 9, as well as a back pressing device 18, comprising the individual drive units 23, 24 with drive control cams 25, 26, which are assigned to a motorized drive 20. The drive 20 comprises a motor 3, which drives the back pressing device 18 approximately at the same speed and in the same conveying direction T as the book blocks, as well as an additional motor 4 that presses the back pressing device 18 against the back 12 of the book block 5. A carriage 6, which can move inside a horizontal longitudinal guide 7, arranged vertically displaceable on the basic frame for the perfect binder, functions as a guiding device for the apparatus 1. A changeable movement path 27 with an approximately elliptical shape for the carriage 6 with the back pressing device 18 and the flank pressing device 15, which is necessary for the function of the apparatus 1, is generated by super imposing a horizontal movement and a vertical movement of the longitudinal guide 7 and/or the carriage 6. When passing through the center section of the upper portion of the movement path 27, the casing 11 or the slip-fold 29 are pressed against the back 12 with the aid of the back pressing device 18 and against the side flanks 13 with the aid of the flank pressing device 15. During the pressing operation, the speed of the back pressing device 18 and the flank pressing device 15 in the transporting direction T must match precisely the speed of the clamps 14 and/or the book blocks 5. The apparatus 1 is therefore driven with the synchronous timing of the clamps 14 of the perfect binder which transport the book blocks.

The slip-folds 29 are pressed on in the same way as the casings 11. However, owing to the fact that the slip-fold legs 29 are only a few millimeters long, the flank pressing device 15 must be operated with a smaller stroke than is required for pressing on the casings 11.

The inside end positions for the rear pressure bar 9 and the front pressure bar 8 can be adjusted to the position of the flanks 13 and/or the thickness or thickness differences for the book blocks 5 to be processed. The strokes for the rear pressure bar 9 and the front pressure bar 8 can also be adjusted and essentially depend on whether casings 11 or slip-folds 29 are pressed against the book blocks 5. The upper end position of the longitudinal guide 7 and/or the back pressing device 18 and the flank pressing device 15 can also be adjusted corresponding to the level of the back 12.

The front pressure bar 8, the rear pressure bar 9, the longitudinal guide 7 and the carriage 6 are provided with separate drives 16, 23, 24 and can be driven back and forth in the direction of the double arrows. The illustrated individual drive units 16, 23, 24 are electric linear drives. However, drive systems with rotary motors and cranks, rack and pinion gear systems, pinion toothed belt drive systems, or spindle nut systems may also be used. The energy can alternatively be supplied either hydraulically or pneumatically. Each individual drive unit 16, 23, 24 comprises a motor 2, 3, 4 and a drive control 19, 25, 26 which supplies the motor 2, 3, 4 with energy. Sensors, that are not shown herein, are connected to the drive controls 19, 25, 26 to continuously measure the position of the individual drive units 16, 23, 24. The energy supply to the associated motors 2, 3, 4 is controlled by drive controls 19, 25, 26, based on a comparison between the desired positions for the individual drive units 16, 23, 24 and the actual positions. Systems of this type are known to one skilled in the art under the term "servo drive." The desired positions for the individual drive units 16, 23, 24 depend on the actual position of the drive for the perfect binder and the movement principle associated with the individual drive units 16, 23, 24. The drive controls 19, 25, 26 for the individual drive units 16, 23, 24 are therefore connected to a control device 17 of the perfect binder, to which a position sensor 28 is assigned for detecting the position of the drive for the perfect binder. Owing to the fact that each drive axis is assigned an individual drive unit 16, 23, 24, drive parameters can be changed at any time without manual interventions, even during the production. A further advantage is the fact that each individual drive unit 16, 23, 24 can be adjusted optimally to the driving force required for driving the associated element, thus protecting each individual drive unit 16, 23, 24 against an excess load. The control device 17 is furthermore provided with an input unit 21, for example a keyboard, for the input of product data and production data and with an output unit 22, for example a monitor, for the output of error messages and other data. According to an alternative embodiment, the input unit 21 and the output unit 22 may take the form of a so-called "touch screen system."

It will be understood that the above description of the present invention is susceptible to various modifications, changes and adaptations, and that the same are intended to be comprehended within the meaning and range of equivalents of the appended claims.

What is claimed is:

1. An apparatus, comprising:

a perfect binder comprising a control device and a circulating clamp operating under control of the control device to transport the circulating clamp in the transport direction while a book block is clamped into the circulating clamp such that a back of the book block projects downward;

a back pressing device that presses a casing or slip-fold against an adhesive-covered back of the book block;

a flank pressing device that presses the casing or slip-fold against side flanks of the book block, wherein the back pressing device and the flank pressing device are operated synchronously with the timing of the circulating clamp of the perfect binder for conveying the book block;

a first individual drive unit assigned to the flank pressing device and connected to the control device of the perfect binder; and a drive assigned to the back pressing device, the drive including a second individual drive unit and a third individual drive unit, each including a drive control, wherein the second individual drive unit includes a motor that drives the back pressing device approximately in the same direction as the transport direction of the book block, and the third individual drive unit includes a different motor that presses the back pressing device against the back of the book block.

2. The apparatus according to claim 1, wherein the flank pressing device comprises at least one driven pressure bar and the first individual drive unit comprises a drive control and a controllable motor connected to the pressure bar.

3. The apparatus according to claim 1, wherein the flank pressing device is adjustable as a function of thickness of the book blocks.

4. The apparatus according to claim 1, wherein the individual drive units for the pressing device are independently controllable.

5. The apparatus according to claim 1, wherein the second individual drive unit and the third individual drive unit move the back pressing device in an elliptical path.

6. The apparatus according to claim 5, wherein the elliptical path is changeable.

7. The apparatus according to claim 1, wherein the positions for the individual drive units depend on a movement principle associated with the individual drive units, the drive controls for the individual drive units being connected to the control device of the perfect binder.

* * * * *